US007574879B2

(12) United States Patent
Chang et al.

(10) Patent No.: US 7,574,879 B2
(45) Date of Patent: Aug. 18, 2009

(54) DRUM WASHING MACHINE

(75) Inventors: Jae won Chang, Gunpo-si (KR); Hee Tae Lim, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 290 days.

(21) Appl. No.: 11/187,927

(22) Filed: Jul. 25, 2005

(65) Prior Publication Data

US 2006/0150687 A1 Jul. 13, 2006

(30) Foreign Application Priority Data

Jan. 10, 2005 (KR) ..... 10-2005-0002136

(51) Int. Cl.
*D06F 37/22* (2006.01)

(52) U.S. Cl. ..... 68/24; 68/58; 68/140

(58) Field of Classification Search ..... 68/24, 68/184; 134/184, 198
See application file for complete search history.

(56) References Cited

U.S. PATENT DOCUMENTS

| | | | | | |
|---|---|---|---|---|---|
| 2,565,604 | A | * | 8/1951 | Geiger | 68/140 |
| 2,930,217 | A | * | 3/1960 | Rehmke | 68/23.1 |
| 3,089,326 | A | * | 5/1963 | Belaieff | 68/23.2 |
| 3,206,267 | A | * | 9/1965 | Gruner et al. | 312/228 |
| 3,459,461 | A | * | 8/1969 | Bannon, Jr. | 312/257.1 |
| 3,531,954 | A | * | 10/1970 | Krupsky | 68/18 F |
| 4,446,706 | A | * | 5/1984 | Hartwig | 68/24 |
| 5,768,730 | A | * | 6/1998 | Matsumoto et al. | 8/159 |
| 5,870,905 | A | * | 2/1999 | Imamura et al. | 68/12.04 |
| 6,032,494 | A | * | 3/2000 | Tanigawa et al. | 68/12.06 |
| 6,981,395 | B2 | * | 1/2006 | Ryu et al. | 68/17 R |
| 2004/0025544 | A1 | | 2/2004 | Kim et al. | |
| 2004/0237603 | A1 | | 12/2004 | Kim et al. | |
| 2005/0028564 | A1 | | 2/2005 | Lee et al. | |

FOREIGN PATENT DOCUMENTS

| | | | |
|---|---|---|---|
| DE | 31 09 641 | * | 2/1982 |
| DE | 3811583 | | 10/1989 |
| DE | 39 34 434 | * | 4/1991 |
| DE | 4310594 | | 6/1994 |
| DE | 4330079 | | 3/1995 |
| EP | 1386996 | | 2/2004 |
| EP | 1505191 | | 2/2005 |
| FR | 2 401 888 | * | 7/1975 |
| JP | 4-92697 | * | 3/1992 |
| KR | 10-20040011307 | | 2/2004 |

OTHER PUBLICATIONS

English language Abstract of KR 10-2004-0011307.

* cited by examiner

*Primary Examiner*—Frankie L Stinson
(74) *Attorney, Agent, or Firm*—Birch, Stewart, Kolasch & Birch, LLP

(57) ABSTRACT

A drum washing machine includes a cabinet forming an external housing of the washing machine, and a tub is installed in the cabinet for containing washing water. A drum is rotatably installed in the tub. A circulation pump pumps the washing water in the tub and resupplies the washing water to the inside of the drum and at least one circulation hose provides a circulation path between the circulation pump and the tub.

18 Claims, 4 Drawing Sheets

DRUM WASHING MACHINE

The present disclosure relates to subject matter contained in priority Korean Application No. 2005-002136, filed on Jan. 10, 2005, the disclosure of which is herein expressly incorporated by reference in its entirety.

BACKGROUND OF THE INVENTION

1. Field of the Invention

The present invention relates to a drum washing machine, and more particularly, to a drum washing machine having a device for circulating washing water supplied to the inside of a drum.

2. Discussion of the Related Art

Generally, a drum washing machine is an apparatus for performing the washing of laundry by rotating a drum under the condition that detergent, washing water, and laundry are placed in the drum. Here, the washing of the laundry is performed by means of friction between the laundry and the washing water and emulsification of the detergent, and simultaneously the laundry is repeatedly lifted and dropped by the rotation of the drum.

Accordingly, the drum washing machine minimizes damage to the laundry and entanglement of the laundry, and has laundry-beating and rubbing effects.

In an initial stage of the operation of the washing machine, the washing water is supplied to the inside of a tub, and soaks the laundry contained in the drum. Preferably, the drum is rotated to perform the washing of the laundry after the laundry is sufficiently soaked by the washing water.

However, the above conventional drum washing machine requires a long time to soak the laundry by means of the supplied washing water, thereby increasing the overall washing time.

Further, the conventional drum washing machine performs the washing of the laundry under the condition that the detergent and the washing water are not completely mixed, thus deteriorating the washing efficiency.

SUMMARY OF THE INVENTION

Accordingly, the present invention is directed to a drum washing machine that substantially obviates one or more problems due to limitations and disadvantages of the related art.

An object of the present invention is to provide a drum washing machine having an improved structure so that washing water circulated by a circulation device is efficiently supplied to the inside of a drum.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum washing machine includes a cabinet forming the external housing of the washing machine; a tub installed in the cabinet for containing washing water; a drum rotatably installed in the tub; a circulation pump for pumping the washing water in the tub and re-supplying the washing water to the inside of the drum; and circulation hoses forming a circulation path between the circulation pump and the tub.

Preferably, the front surface of the tub may be connected to the front surface of the cabinet. An inlet pipe, connected to one circulation hose, for guiding the washing water guided by the circulation hose to the inside of the drum, may be installed on the front surface of the tub. Preferably, the inlet pipe may protrude from the front surface of the tub. The inlet pipe may be formed integrally with the tub. Alternately, the inlet pipe may be formed independently of the tub, and fixed to the front surface of the tub by a fixing mechanism.

The inlet pipe may be installed at a position separated from the upper end of the tub by a designated angle.

Further, preferably, the drum washing machine may also include a guide for guiding the washing water, discharged through the inlet pipe, to the inside of the drum. The guide may be extended to be downwardly inclined towards the inside of the drum. The guide may be formed integrally with the tub. Alternately, the guide may be formed independently of the tub, and fixed to the front end of the tub by a fixing mechanism.

Preferably, a bearing housing may be fixed to the rear surface of the tub, and the lower part of the bearing housing may be extended and supported by suspension springs and a damper. Here, the extended lower part of the bearing housing may be forwardly bent to have an approximately 'L' shape. A bracket for reinforcing the strength of the bearing housing may be connected to the extended lower part of the bearing housing.

In another aspect of the present invention, a drum washing machine includes a cabinet forming the external housing of the washing machine; a tub, installed in the cabinet for containing washing water, the front surface of which is connected to the front surface of the cabinet; a drum rotatably installed in the tub; a circulation pump for pumping the washing water in the tub and re-supplying the washing water to the inside of the drum; and circulation hoses, for forming a circulation path between the circulation pump and the tub, one end of which is connected to the front surface of the tub.

In yet another aspect of the present invention, a drum washing machine includes a cabinet forming the external housing of the washing machine; a tub, installed in the cabinet for containing washing water, the front surface of which is connected to the front surface of the cabinet; a drum rotatably installed in the tub; a circulation pump for pumping the washing water in the tub and re-supplying the washing water to the inside of the drum; circulation hoses forming a circulation path between the circulation pump and the tub; and a guide extended to be downwardly inclined towards the inside of the drum for guiding the washing water discharged through the circulation hoses.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

The above and other objects, features and advantages of the present invention will be made apparent from the following description of the preferred embodiments, given as non-limiting examples, with reference to the accompanying drawings in which.

DETAILED DESCRIPTION OF THE INVENTION

Figure 1:
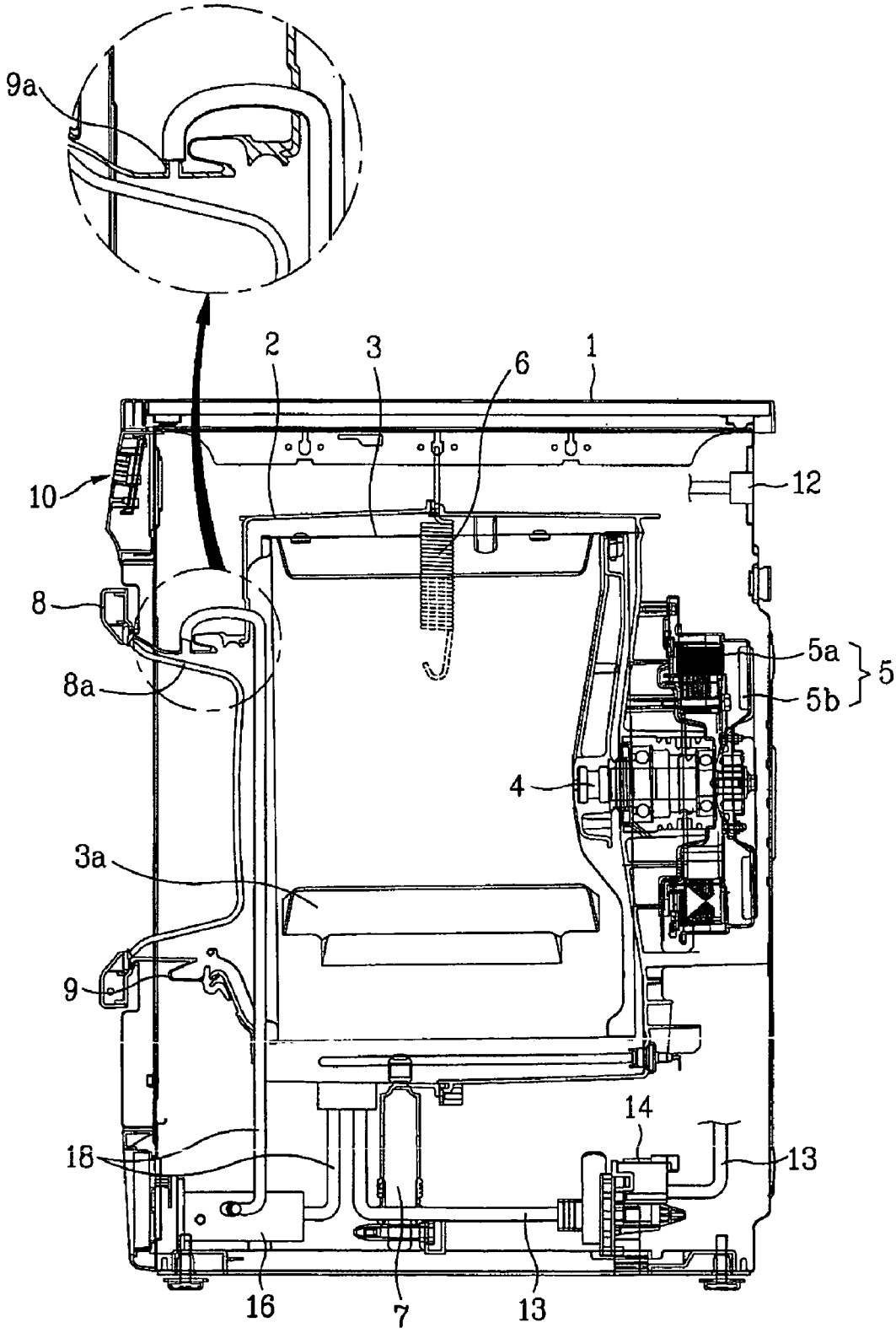
FIG. 1 is a sectional view of a drum washing machine in accordance with one embodiment of the present invention.

The present invention is further described in the detailed description which follows, by reference to the noted plurality of drawings by way of non-limiting examples of preferred embodiments of the present invention, in which like reference numerals represent similar parts throughout the several views of the drawings, and wherein:

Hereinafter, drum washing machines in accordance with the preferred embodiments of the present invention will be described in detail with reference to the accompanying drawings.

FIG. 1 is a sectional view of a drum washing machine in accordance with one embodiment of the present invention.

As shown in FIG. 1, the drum washing machine of one embodiment comprises a cabinet 1, a tub 2, a drum 3, and a driving motor 5.

The cabinet 1 forms the external housing of and defines the external appearance of the drum washing machine, and the tub 2 for containing washing water is installed in the cabinet 1. The drum 3 is rotatably installed in the tub 2, and the rear surface of the drum 3 is connected to the driving motor 5.

The driving motor 5 includes a rotor 5*b* and a stator 5*a*. A driving shaft 4 connected to the drum 3 for transmitting the rotary force of the rotor 5*b* directly to the drum 3, which is directly connected to the rotor 5*b*.

A door 8 is provided on the front surface of the cabinet 1 at a position corresponding to an opening of the drum 3, and a gasket 9 for maintaining the hermetic sealing of the drum 3 is provided between the door 8 and the drum 3. A control panel 10 for receiving operating instructions from a user and controlling the overall operation of the washing machine is installed on the front surface of the washing machine above the door 8.

A water supply valve 12 connected to a water supply (not shown) for supplying warm and cool water is installed on the rear surface of the cabinet 1. A drainage valve 14 connected to a drainage hose 13 for forcibly discharging the washing water from the tub 2 to the outside is installed on the lower part of the rear surface of the cabinet 1.

The drum washing machine pumps and circulates the washing water stored in the tub 2 using a circulation pump, thereby improving washing and rinsing performance. For this reason, the circulation pump 16 for circulating the washing water stored in the tub 2 is installed, for example, in the lower part of the cabinet 1. The circulation pump 16 pumps the washing water, and moves the washing water to the upper part of the tub 2. Then, the pumped washing water is guided by circulation hoses 18 connected to the circulation pump 16, and one end of one circulation hose 18 is connected to the gasket 9 installed in front of the tub 2.

Thereby, the pumped washing water is supplied again to the inside of the tub 2, and more easily soaks the laundry. Further, since the washing water and the detergent are well mixed by the above circulation of the washing water, it is possible to improve the washing efficiency of the washing machine when the washing operation is performed by the driving of the drum 3.

An inlet pipe 9*a* connected to one end of the circulation hose 18 is provided at one side of the gasket 9. Preferably, the inlet pipe 9*a* is formed integrally with the gasket 9. However, the inlet pipe 9*a* may be installed independently of the gasket 9 as a separate component.

Through the above configuration, the washing water stored in the tub 2 is pumped by the circulation pump 16 along the circulation hose 18 in washing and rinsing operations, and is introduced again to the inside of the drum 3, thereby improving the washing and rinsing performance. Thereafter, the drainage pump 14 is operated in a discharging operation when the operation of the circulation pump 16 is stopped, thereby discharging the washing water in the tub 2 to the outside through the drainage hose 13.

Since the gasket 9 is made of rubber, the gasket 9 is severely vibrated in the washing and rinsing operations. Thereby, the washing water supplied through the inlet pipe 9*a* is not efficiently supplied to the inside of the drum 3, and flows downwardly along a glass 8*a* of the door 8. In this case, it is difficult for the circulated washing water to sufficiently impact the laundry.

Accordingly, in order to solve the above problem, a drum washing machine in accordance with another embodiment of the present invention will be described, as follows.

Figure 2:
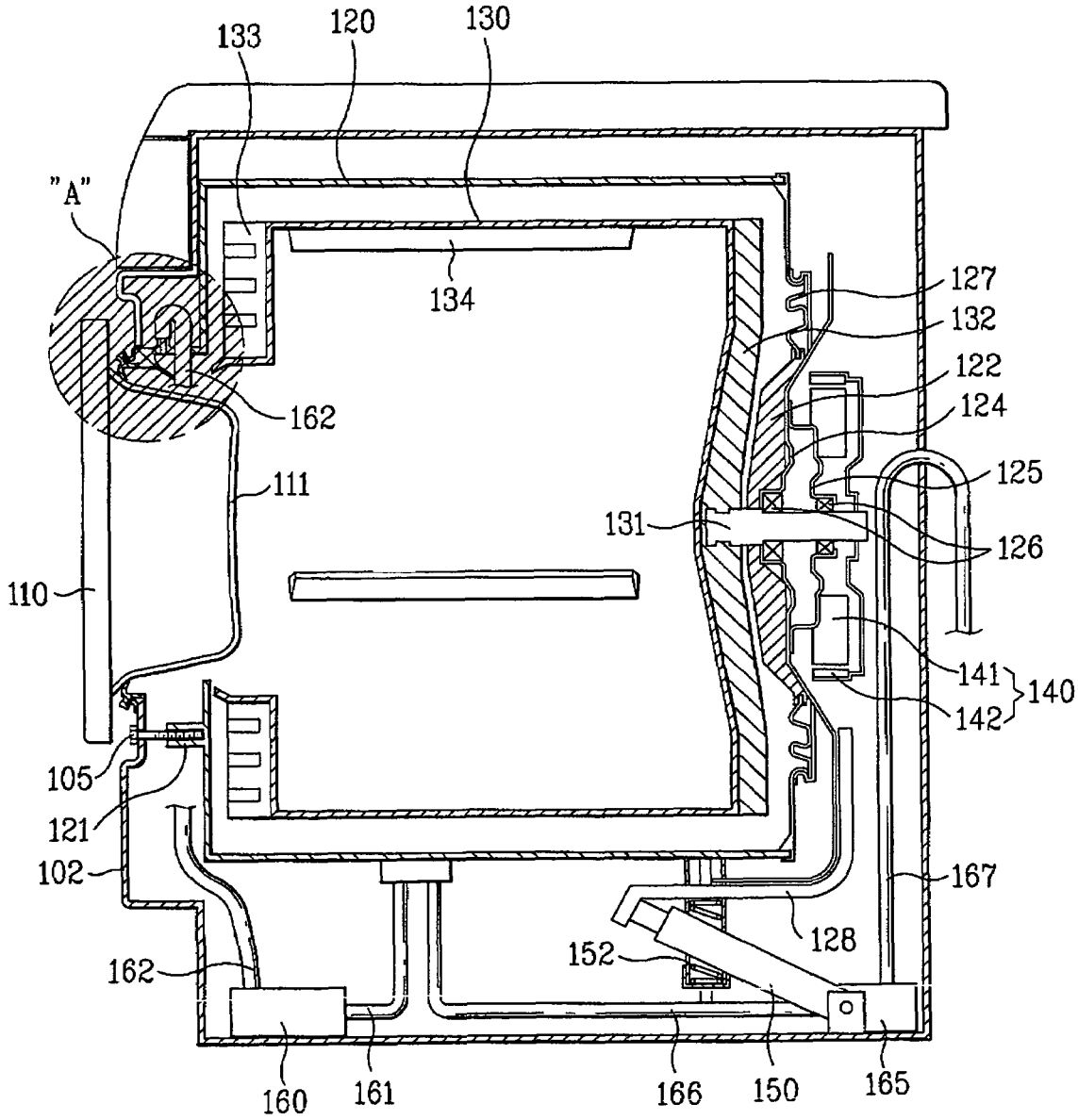
FIG. 2 is a sectional view of a drum washing machine in accordance with another embodiment of the present invention.
Figure 3:
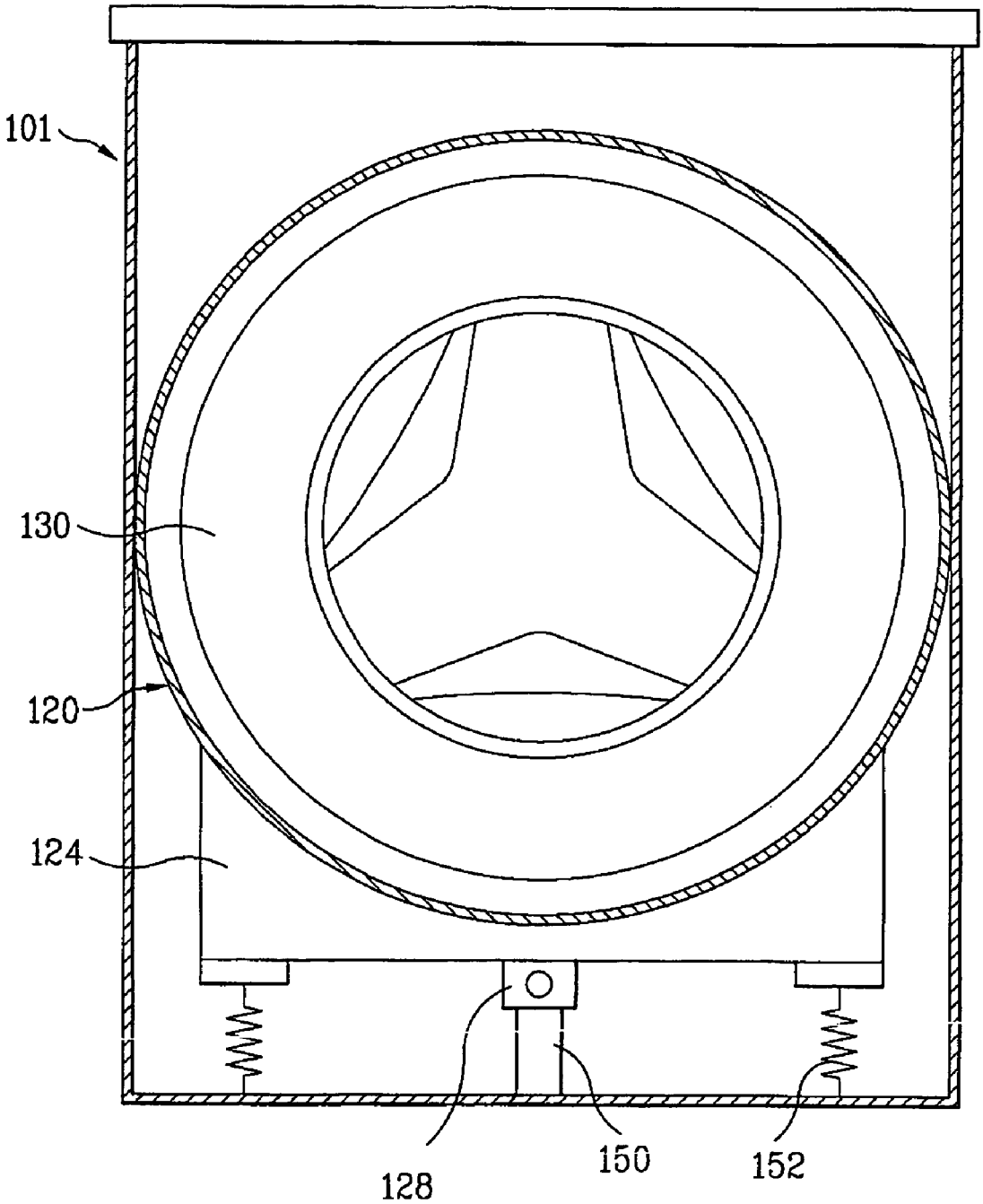
FIG. 3 is a front view of the drum washing machine of FIG. 2.

FIG. 2 is a sectional view of the drum washing machine in accordance with another embodiment of the present invention, and FIG. 3 is a front view of the drum washing machine of FIG. 2.

As shown in FIGS. 2 and 3, the drum washing machine comprises a cabinet 101, a tub 120, and a drum 130. The cabinet 101 forms the exterior housing and defines the external appearance of the drum washing machine, and an opening for placing laundry in the cabinet 101 is formed through the front surface of the cabinet 101.

The tub 120 provided with an opening formed through the front surface thereof for containing washing water is installed in the cabinet 101.

The cylindrical drum 130, the front surface of which is openable, is rotatably provided in the tub 120. Preferably, a plurality of lifters 134 for lifting and dropping the laundry when the drum 130 is rotated are formed on the inner cylindrical surface of the drum 130 such that the lifters 134 are separated from each other by a designated interval.

The cabinet 101 has the shape of a rectangular parallelepiped, and a front panel 102 is installed on the front surface of the cabinet 101. An opening for placing the laundry in the tub 120 therethrough is formed through the front panel 102, and a door 110 is rotatably connected to one side of the opening. Here, the front panel 102 may be formed integrally with the cabinet 101, or may be a separate component attached to the cabinet 101.

A plurality of bosses 121 are formed on the front surface of the tub 120 in the circumferential direction, and bolts 105 are respectively inserted into the bosses 121, thereby fixing the front surface of the tub 120 to the front panel 102. Preferably, the bolts 105 are fixedly inserted into the bosses 121 from the front of the front panel 102.

A back spider-like structure 122 having a slightly smaller diameter than the outer diameter of the tub 120 is installed in the rear of the tub 120. A gasket 127 for preventing the leakage of the washing water is provided between the rear surface of the tub 120 and the back spider 122. A first bearing housing 124 and a second bearing housing 125 are assembled on the rear surface of the back spider 122. Bearings 126 for rotatably supporting a driving shaft 131 connected to the rear surface of the drum 130 are provided in the first and second bearing housings 124 and 125.

A drum spider-like structure 132, to which the inner end of the driving shaft 131 is fixed, is fixed to the rear surface of the drum 130. A balance weight 133 for smoothing the rotation of the drum 130 is installed on the front surface of the drum 130. The driving shaft 131 of the drum 130 passes through the back spider 122 and the first and second bearing housings 124 and 125, and the outer end of the driving shaft 131 is connected to a driving motor 140.

The driving motor 140 includes a stator 141 fixed to the rear surface of the second bearing housing 125, and a rotor 142 connected to the driving shaft 131. When power is supplied to the stator 141, a rotating magnetic field is formed between the rotor 142 and the stator 141, and the rotor 142 is rotated along the outer cylindrical surface of the stator 141.

Two suspension springs 152 for supporting the rear part of the tub 120 are installed at both sides of the extended lower part of the first bearing housing 124 connected to the back spider 122. The extended lower part of the first bearing housing 124 is forwardly bent to have an approximately 'L' shape, and an 'L'-shaped bracket 128 is connected to the extended lower part of the first bearing housing 124.

The damper 150 for absorbing the vibration of the drum 130 is connected to the front part of the bracket 128. The damper 150 is inclined and supported to the rear surface of the cabinet 101, thereby efficiently absorbing both longitudinal and lateral vibrations of the bearing housings 124 and 125.

The length of the bracket 128 may be modified so that the suspension springs 152 and the damper 150 are installed at positions corresponding to the center of gravity of an assembled structure of the drum 130, the tub 120, and the driving motor 140 including the bearing housings 124 and 125.

A drainage pump 165 is installed in the lower portion of the rear part of the cabinet 101. The drainage pump 165 pumps and discharges the washing water contained in the tub 120 to the outside through first and second drainage hoses 166 and 167 made of elastic material after the washing of the laundry is completed.

A circulation pump 160 for pumping the washing water, supplied to the tub 120, to the outside of the tub 120 and re-supplying the washing water to the inside of the tub 120 is installed in the lower portion of the cabinet 101. An inlet of the circulation pump 160 is connected to a first circulation hose 161, which is made of elastic material and connected to the lower part of the tub 120, and an outlet of the circulation pump 160 is connected to a second circulation hose 162, which is made of elastic material and connected to the upper part of the tub 120.

Figure 4:
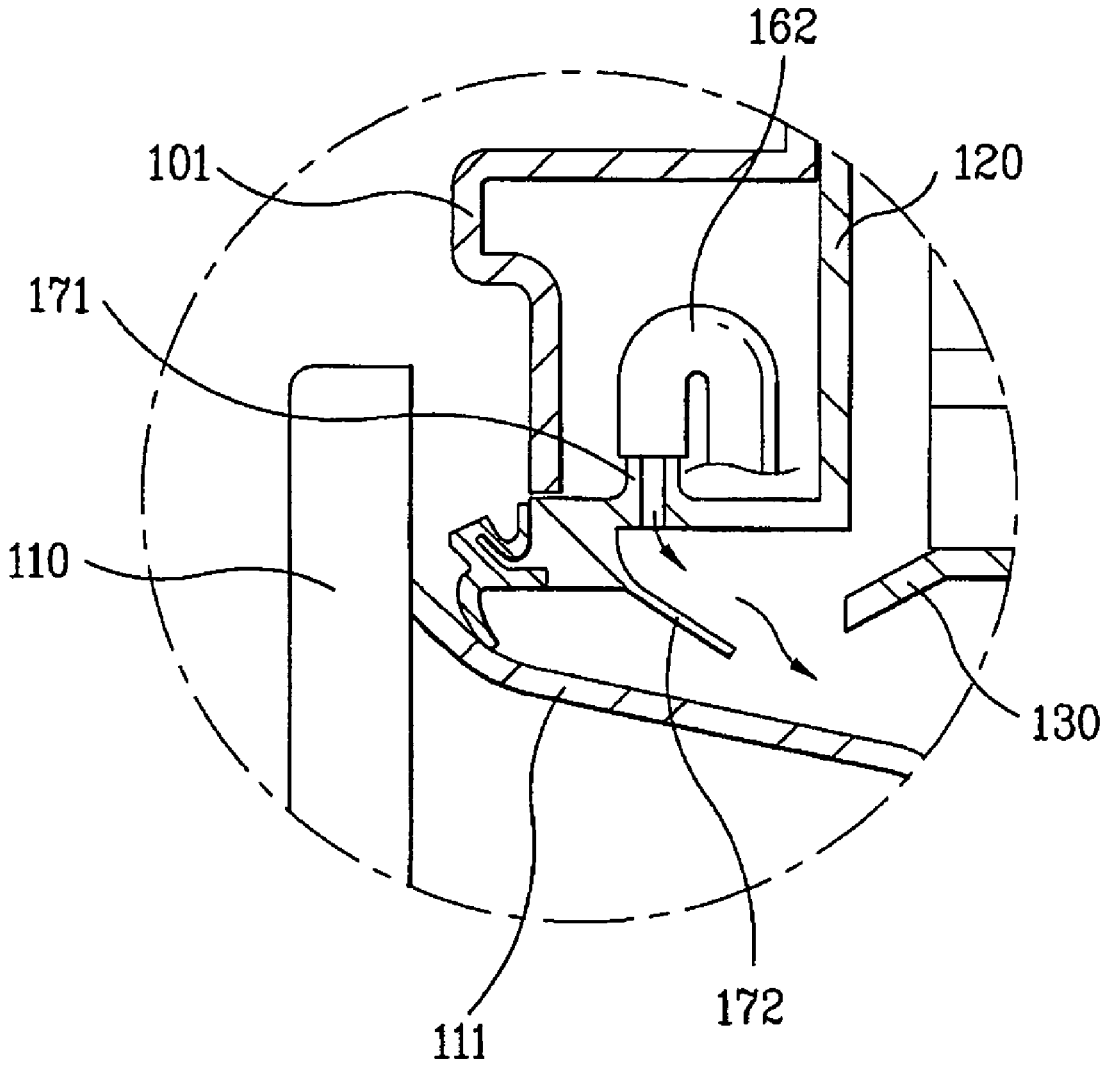
FIG. 4 is an enlarged view of the portion "A" of FIG. 2.

FIG. 4 is an enlarged view of the portion "A" of FIG. 2, i.e., an enlarged sectional view of the connection portion of the second circulation hose 162 of the present invention.

As shown in FIG. 4, an inlet pipe 171 protrudes or extends from the front surface of the tub 120, and one end of the second circulation hose 162 is connected to the inlet pipe 171. Preferably, the inlet pipe 171 is installed at a position spaced from the zenith (or foremost point) of the front surface of the tub 120 by an angle of approximately 30 degrees.

A guide 172 is provided just under the inlet pipe 171, and serves to guide the washing water introduced through the inlet pipe 171 to the inside of the drum 130. Accordingly, preferably, the guide 172 is downwardly inclined towards the opening of the drum 130. Further, preferably, a spray nozzle for spraying the circulated washing water is installed at one side of the inlet pipe 171.

The inlet pipe 171 and the guide 172 may be formed integrally with the front surface of the tub 120, or may be formed independently of the front surface of the tub 120. In the case that the inlet pipe 171 and the guide 172 are formed independently of the front surface of the tub 120, preferably, the inlet pipe 171 and the guide 172 are fixed to the front surface of the tub 120 using an adhesive agent or screws.

Hereinafter, the operation of the above drum washing machine of the present invention will be described.

When a user places laundry in the drum 130 and applies power to the drum washing machine to drive the washing machine, washing water is supplied to the inside of the tub 120 through the water supply device (not shown) provided in the cabinet 101. Preferably, the washing water is mixed with detergent and is then supplied to the inside of the tub 120.

When the supply of the washing water is completed, a signal is applied to the driving motor 140. Then, the rotor 142 is rotated along the outer cylindrical surface of the stator 141, and thus the drum 130 connected to the rotor 142 is rotated so that the laundry in the drum 130 is washed. Here, since the circulation pump 160 is periodically operated, a part of the washing water in the tub 120 is circulated through the first circulation hose 161 and the second circulation hose 162.

The washing water pumped by the circulation pump 160 through the second circulation hose 162 is introduced to the inside of the tub 120 through the inlet pipe 171. The washing water is guided to the inside of the drum 130 by the guide 172, and is sprayed onto the laundry in the drum 130. Here, the sprayed washing water collides with the laundry, and sufficiently soaks the laundry under the condition that the washing water is mixed with the detergent.

In the case that the washing water is discharged to the outside during or after the washing and rinsing operations, the drainage pump 165 while the operation of the circulation pump 160 is stopped, thereby discharging the washing water contained in the tub 120 to the outside through the first and second drainage hoses 166 and 167.

As described above, the drum washing machine of the present invention has several effects, as follows.

Since the front surface of the tub is directly connected to the cabinet of the drum washing machine, the circulation hose connected to the circulation pump is stably fixed to the inlet pipe provided on the front surface of the tub. Thereby, it is possible to prevent the washing water, re-supplied to the inside of the tub through the circulation pump, from flowing down along the door.

Further, since the washing water, circulated through the front surface of the tub, is smoothly supplied to the inside of the drum, the washing water sufficiently soaks the laundry in the drum. Thereby, it is possible to improve washing and rinsing performances of the drum washing machine.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

Although the invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

What is claimed is:

1. A drum washing machine comprising:

a cabinet having a front panel and forming an external housing of the washing machine;

a tub installed in the cabinet to contain washing water and having a plurality of bosses formed on the front surface, the tub being fixed directly to the front panel of the cabinet by inserting bolts fixedly into the bosses;

a drum rotatably installed in the tub;

a bearing housing rotatably supporting a driving shaft of the drum, and a lower part of the bearing housing being supported by a suspension spring and a damper;

a circulation pump that pumps the washing water in the tub and resupplies the washing water to the inside of the drum; and at least one circulation hose providing a circulation path between the circulation pump and the tub.

2. The drum washing machine as set forth in claim 1, wherein an inlet pipe, connected to a circulation hose that guides the washing water conveyed by the circulation hose to the inside of the drum, is installed on the front surface of the tub.

3. The drum washing machine as set forth in claim 2, wherein the inlet pipe protrudes from the front surface of the tub.

4. The drum washing machine as set forth in claim 2, wherein the inlet pipe is integral with the tub.

5. The drum washing machine as set forth in claim 2, wherein the inlet pipe is distinct from the tub, and is secured to the front surface of the tub by a fixing device.

6. The drum washing machine as set forth in claim 2, wherein the inlet pipe is located at a position spaced from the upper end of the tub by a predetermined angle.

7. The drum washing machine as set forth in claim 2, further comprising a guide for guiding the washing water, discharged through the inlet pipe, to the inside of the drum.

8. The drum washing machine as set forth in claim 7, wherein the guide is configured to incline downwardly towards the inside of the drum.

9. The drum washing machine as set forth in claim 7, wherein the guide is integral with the tub.

10. The drum washing machine as set forth in claim 7, wherein the guide is distinct from the tub, and secured to the front end of the tub by a fixing device.

11. The drum washing machine as set forth in claim 1, wherein the lower part of the bearing housing is configured to have an approximately "L" shape, with a portion of the "L" shape of the lower part of the bearing housing extending forwardly.

12. The drum washing machine as set forth in claim 11, wherein a bracket for reinforcing the bearing housing is connected to the lower part of the bearing housing.

13. A drum washing machine comprising:

a cabinet forming an external housing of the washing machine;

a tub coupled directly to a front portion of;

a drum rotatably installed in the tub;

a circulation pump that pumps the washing water in the tub and resupplies the washing water to the inside of the drum;

at least one circulation hose, providing a circulation path between the circulation pump and the tub; and a bearing housing rotatably supporting a driving shaft of the drum, a lower part of the bearing housing being supported by a suspension spring and a damper.

14. The drum washing machine as set forth in claim 13, wherein an inlet pipe connected to a circulation hose that guides the washing water conveyed by the circulation hose to the inside of the drum is installed on the front surface of the tub.

15. The drum washing machine as set forth in claim 14, further comprising a guide that guides the washing water discharged through the inlet pipe to the inside of the drum.

16. A drum washing machine comprising:

a cabinet;

a tub installed in the cabinet;

a drum rotatably installed in the tub;

a circulation pump that pumps washing water in the tub and resupplies the washing water to the inside of a drum;

at least one circulation hose providing a circulation path between the circulation pump and the tub; and a bearing housing rotatably supporting a driving shaft of the drum, a lower part of the bearing housing being supported by a suspension spring and a damper, wherein the tub is coupled directly to a front portion of the cabinet to prevent relative movement generated by vibration between the circulation hose and the tub.

17. The drum washing machine as set forth in claim 16, further comprising an inlet pipe connected to the circulation hose that supplies washing water to the inside of the drum and provided on front surface of the tub, and a guide that guides the washing water discharged through the inlet pipe from the inside of the drum.

18. The drum washing machine as set forth in claim 16, wherein the tub is coupled to the front portion of the cabinet by fastening bolts to bosses formed on the front surface of the tub.

* * * * *